US011516585B2

(12) United States Patent
Wahlin

(10) Patent No.: US 11,516,585 B2
(45) Date of Patent: Nov. 29, 2022

(54) HEADBAND FOR A PAIR OF HEADPHONES

(71) Applicant: Zound Industries International AB, Stockholm (SE)

(72) Inventor: Erik Wahlin, Lidingö (SE)

(73) Assignee: Zound Industries International AB, Stockholm (SE)

( * ) Notice: Subject to any disclaimer, the term of this patent is extended or adjusted under 35 U.S.C. 154(b) by 81 days.

(21) Appl. No.: 16/976,727

(22) PCT Filed: Feb. 21, 2019

(86) PCT No.: PCT/EP2019/054331
§ 371 (c)(1),
(2) Date: Aug. 28, 2020

(87) PCT Pub. No.: WO2019/166323
PCT Pub. Date: Sep. 6, 2019

(65) Prior Publication Data

US 2020/0413195 A1 Dec. 31, 2020

(30) Foreign Application Priority Data

Mar. 1, 2018 (SE) ..... 1850229-4

(51) Int. Cl.
*H04R 25/00* (2006.01)
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1066* (2013.01)

(58) Field of Classification Search
CPC .. H04R 1/1008; H04R 1/1066; H04R 5/0335; H04R 1/105
(Continued)

(56) References Cited

U.S. PATENT DOCUMENTS 3,919,501 A 11/1975 Cech
5,345,512 A 9/1994 Lee
(Continued)

FOREIGN PATENT DOCUMENTS

EP 2475187 A2 7/2012
JP H10-191491 A 7/1998
(Continued)

OTHER PUBLICATIONS

International Search Report for International Application No. PCT/EP2019/054331 dated Apr. 1, 2019.

*Primary Examiner* — Phylesha Dabney
(74) *Attorney, Agent, or Firm* — Knobbe, Martens, Olson & Bear, LLP

(57) ABSTRACT

A headband (100) for a pair of headphones (10.1, 10.2) comprising:—a primary headband portion (110) having a first end (111) and a second end (112) configured to be connected to a respective headphone (10.1, 10.2) and an arc-shaped primary headband section (200) extending between the first and the second end (111, 112) of the primary headband portion (110);—an arc-shaped secondary headband section (300) extending along the arc-shaped primary headband section (200) and;—at least a first holding means (120, 121) for holding the arc-shaped secondary headband section (300) to the primary headband portion (110), wherein;—the at least first holding means (120, 121) is fixed to the primary headband portion (110);—the at least first holding means (120, 121) is configured such that the arc-shaped secondary headband section (300) can be moved towards or away from the primary headband section (200) whereby the area (A) delimited between the primary headband portion (110) and the secondary headband section (300) is varied.

13 Claims, 6 Drawing Sheets

(58) Field of Classification Search
USPC ..... 381/379
See application file for complete search history.

(56) References Cited

U.S. PATENT DOCUMENTS

| | | | |
|---|---|---|---|
| 2003/0210801 | A1 | 11/2003 | Naksen et al. |
| 2014/0263493 | A1 | 9/2014 | Amurgis et al. |
| 2016/0212519 | A1 | 7/2016 | Henderson |
| 2017/0264992 | A1 | 9/2017 | Wallace et al. |

FOREIGN PATENT DOCUMENTS

| | | | |
|---|---|---|---|
| JP | H11-55776 | A | 2/1999 |
| JP | 3454282 | B2 | 10/2003 |
| JP | 2013 258464 | A | 12/2013 |

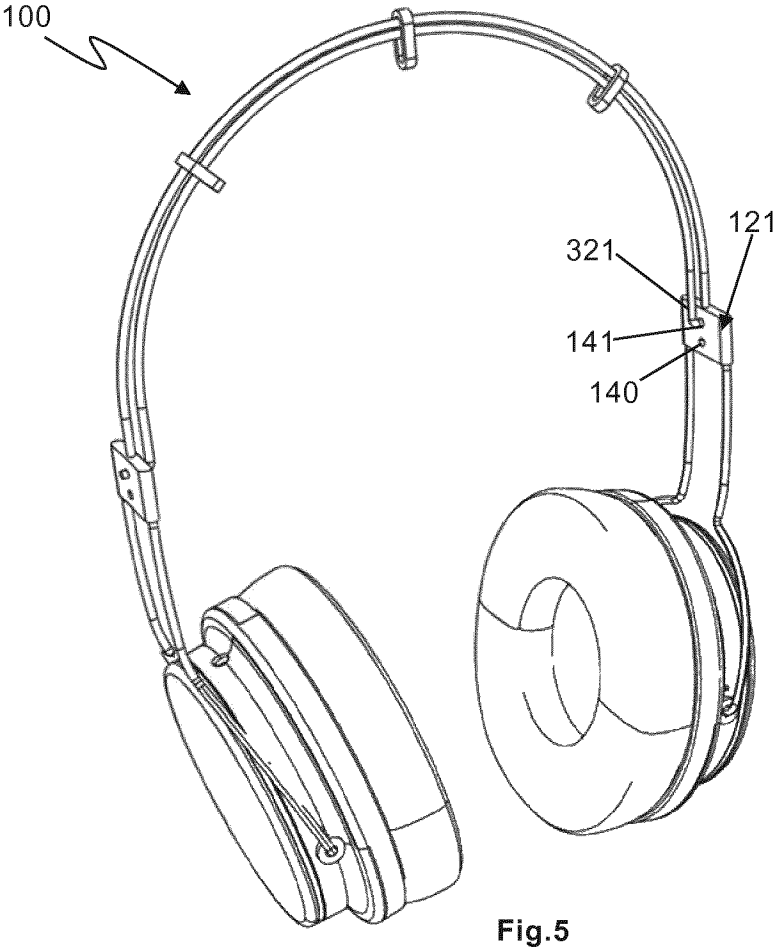
Fig.5
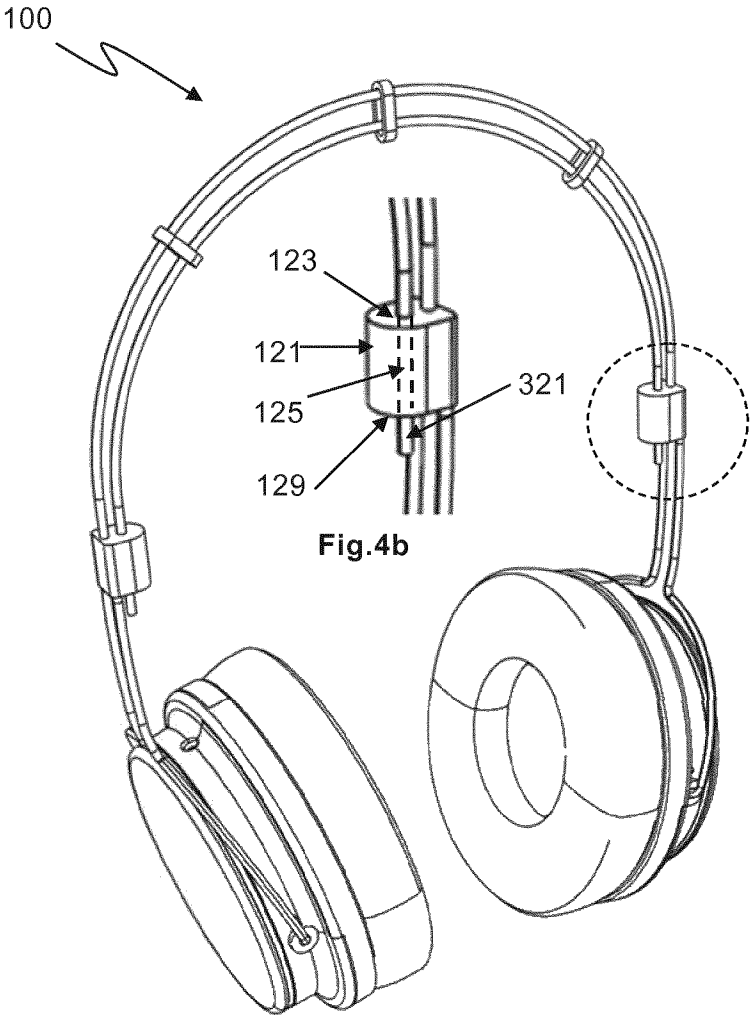
Fig.4b
Fig.4a

HEADBAND FOR A PAIR OF HEADPHONES

CROSS REFERENCE TO RELATED APPLICATIONS

This application is a U.S. National Phase Application of PCT International Application Number PCT/EP2019/054331, filed on Feb. 21, 2019, designating the United States of America and published in the English language, which claims priority to Sweden Application No. 1850229-4, filed Mar. 1, 2018. The disclosures of the above-referenced applications are hereby expressly incorporated by reference in their entireties.

TECHNICAL FIELD

The present disclosure relates to a headband for a pair of headphones. The present disclosure also relates to a headset comprising a headband and a pair of headphones.

BACKGROUND ART

A pair of headphones are typically interconnected by a headband into a headset that is worn on the head of a user. The headphones typically comprises ear-cups that are worn over the ears of the user. Alternatively, the headphones may be in the form of earbuds that are inserted into the ear of the user. Such earbuds may also be interconnected by a headband to form a headset.

A general problem related to headsets is that the user may perceive the clamping force exerted by the headphones onto the ears as uncomfortable. The clamping force from the headphones onto the ears is mainly dependent on a combination of size and stiffness of the headband. Due to production economy, headbands are typically manufactured in one or a few sizes that have been selected to fit one or a few average user head sizes. The headbands, even when available in different sizes, are typically manufactured in the same material, such as spring steel, and have thus essentially the same rigidity.

Attempts have been made to provide headbands that allow the user to control the clamping force of the headset. US2014/0263493 shows a headband that comprises two steel strips that have been aligned and joined together by movable clamps. By changing the spacing between the movable clamps the user may increase or decrease the stiffness of the headband. However, a drawback of the headband of US2014/0263493 is that it is awkward for the user to move the clamps when the headband is worn on the head. In addition the contact between the movable clamps and the head of the user may cause involuntary displacement of the clamps.

SUMMARY OF THE DISCLOSURE

Thus, it is an object of the present disclosure to provide an improved headband for a pair of headphones that solves or at least mitigates at least one of the problems discussed above. In detail, it is an object of the present disclosure to provide a headband for a pair of headphones that allows for easy adjustment of the stiffness of the headband. It is also an object of the present disclosure to provide a headband for a headset that allows for accurate adjustment of the stiffness of the headband. Yet a further object of the present disclosure to provide a headband for a headset that allows for accurate adjustment of the stiffness of the headband and that may be realized at a low cost.

According to the present disclosure, at least one of these objects is achieved by a headband 100 for a pair of headphone 10.1, 10.2 comprising:

a primary headband portion 110 having a first end 111 and a second end 112 configured to be connected to a respective headphone 10.1, 10.2 and an arc-shaped primary headband section 200 extending between the first and the second end 111, 112 of the primary headband portion 110;

an arc-shaped secondary headband section 300 extending along the arc-shaped primary headband section 200 and;

at least a first holding means 120, 121 for holding the arc-shaped secondary headband section 300 to the primary headband portion 110, characterized in that;

the at least first holding means (120, 121) is fixed to the primary headband portion (110);

the at least first holding means 120, 121 is configured such that the arc-shaped secondary headband section 300 can be moved towards or away from the primary headband section 200) whereby the area (A) delimited between the primary headband portion 110 and the secondary headband section 300 is varied.

The advantage of the headband according to the present disclosure is that the stiffness of the headband may be adjusted by varying the area A delimited by the primary headband portion and the secondary headband section. This makes it possible for the user to customize the stiffness of the headband in view of the personal preference. It has shown that the stiffness of the headband is increased when the secondary headband is moved away from the primary headband (increase of area A) and that the stiffness of the headband decreases when the secondary headband is moved towards the primary headband (decrease of area A). It has further shown that the stiffness of the headband is increased when the primary- and secondary headband sections are coupled by joining means.

The particular design of the headband allows for easy adjustment of the stiffness of the headband. In particular, by fixing the holding means to the primary headband portion, the holding means may always be in a specific position where they are easy to locate and reach by the user. Even when the band is worn on the head. This provides for easy and comfortable adjustment of the holding means 120.

The at least first holding means is configured to hold the secondary headband section 300 immovable in a selected position relative the primary headband section 200. Typically such that the secondary headband section is prevented from moving relative the primary headband portion when subjected by external forces. This prevents incidental change of stiffness of the head band.

Preferably, the at least first holding means 120, 121 is configured such that the secondary headband section is movable axially relative the primary headband portion. This, optimizes the stiffness adjustment.

Preferably, the at least first holding means 120, 121 is configured such that the secondary headband section is movable step-less relative the primary headband portion. This allows for high accuracy of the stiffness adjustment.

In an embodiment, the holding means 120, 121 are configured such that the arc-length of the secondary headband section 300 is decreased when the secondary headband section 300 is moved away from the primary headband portion 110 and such that the arc-length of the secondary headband section 300 is increased when the secondary headband section is moved towards the primary headband portion 110. This provides the possibility to achieve high stiffness in the headband.

Preferably, the at least first holding means 120 comprises a through bore 125 for receiving the at least first end 321 of the secondary headband section 300, wherein said through bore 125 is oriented substantially parallel with a symmetry axis (X) of the headband 100 and wherein the first end 321 of the secondary headband section 300 is axially movable in the through bore 100 and lockable in a selected axial position. This is an effective and reliable way of reducing the arc-length of the secondary headband portion and thereby increase the stiffness of the headband even further.

A functional description of the headband according to the present disclosure is schematically disclosed in FIGS. 6*a, b* and 7*a, b*.

Further alternatives and advantages are disclosed in the following description and appended claims.

BRIEF DESCRIPTION OF THE DRAWINGS

FIG. 4*a*: A schematic drawing of a headband according to an alternative of the present disclosure and a pair of headphones.

FIG. 4*b*: A schematic drawing of a detail of the headband according to the present disclosure.

FIG. 5: A schematic drawing of a headband according to an alternative of the present disclosure and a pair of headphones.

DETAILED DESCRIPTION OF EMBODIMENTS

The headband according to the present disclosure will now be described more fully hereinafter. The headband according to the present disclosure may however be embodied in many different forms and should not be construed as limited to the embodiment set forth herein. Rather, this embodiment is provided by way of example so that this disclosure will be thorough and complete, and will fully convey the scope of the present disclosure to those persons skilled in the art.

Figure 1:
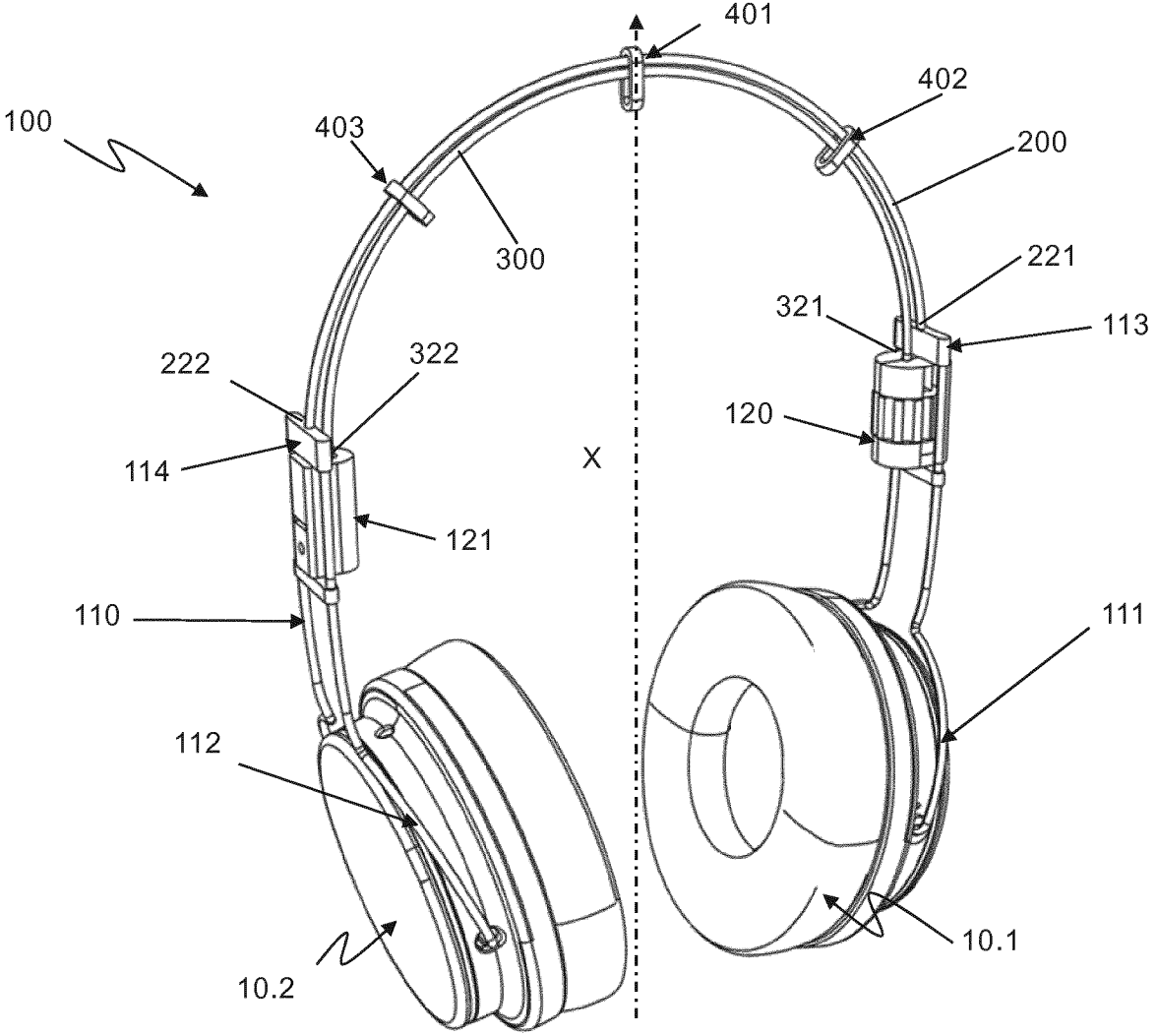
FIG. 1: A schematic drawing of a headband according to the present disclosure and a pair of headphones.

FIG. 1 shows headband 100 according to the present disclosure that is connected to a pair of headphones 10.1, 10.2.

The headband 100 comprise a primary headband portion 110 having a first end 111 and a second end 112 which are configured to be connected to a respective headphone 10.1, 10.2. The primary headband portion 110 further comprises a primary headband section 200 which is arc-shaped and configured to extend over the head of a user (not shown) wearing the headband 100. The primary headband section 200 is elongated and bendable and may be of circular, semi-circular or rectangular cross-section. For example, the primary headband section 200 comprises, i.e. is manufactured of a metal wire or metal strip of spring steel or composite or plastic that has been bent into an arc. The primary headband section 200 comprises a first end 221 and a second end 222.

The primary headband section 200 extends between the first and the second end 111, 112 of the primary headband portion. The first end 221 of the primary headband section may be attached to a first joining portion 113 and to a second joining portion 114 of the primary headband portion. The primary headband section 200 is thereby immovable fixed to the joining portions 113, 114 by e.g. a screw joint or by press-fitting, welding or gluing. In the embodiment shown in FIG. 1, the first and second ends 111, 112 of the headband portion 110 extends from the joining portions 113, 114.

According to the present disclosure, the headband 100 comprises a secondary headband section 300 that extends along the primary headband section 200. To increase legibility, the features relating to the secondary headband section 300 have been indicated by straight lines. Features relating to the primary headband portion 110 have been indicated by arrows.

The secondary headband section 300 is also arc-shaped, elongated and flexible and comprises a first end 321 and a second end 322 (partially visible in FIG. 1). In the embodiment shown in FIG. 1, the secondary headband section 300 is arranged underneath the first headband section 200. That is, the convex side of the secondary headband section 300 extends along the concave side of the primary headband section. However, it is possible that the secondary headband section 300 is arranged above the primary headband section 200. That is, the concave side of the secondary headband section 300 extends along the convex side of the primary headband section 200. The secondary headband section 300 thereby extends parallel with the primary headband section 200. That is, the primary and the secondary headband sections 200 extend in the same plane.

An imaginary symmetry axis X extends through the center of the headband. The symmetry axis X indicates the axial direction. With regards to the symmetry axis X "upwards" is the axial direction from the headphones 10.1, 10.2 towards the primary headband section 200. Correspondingly is "downwards" the axial direction from the primary headband section 200 towards the headphones 10.1, 10.2. The secondary headband section 200 is thus movable axially in the axial direction defined by the symmetry axis X.

According to the present disclosure, the primary headband portion 110 comprises at least a first holding means 120, which is configured to receive a first end 321 of the secondary headband section 300. FIG. 1 shows an embodiment with a first and a second holding means 120, 121. The second holding means 121 is configured to receive the second end 322 of the secondary headband section 300. The holding means 120 and 121 are immovable fixed to the primary headband portion 110 on opposite sides of the symmetry axis X. Fixing of the holding means 120, 121 may be achieved by mechanical attachment or welding, gluing or integral forming. The first holding means 110 may be fixed adjacent the first end 221 of the primary headband section 200. The second holding means 121 may be fixed adjacent the second end 222 of the primary headband section 200. The first and second holding means 120, 121 may be denominated "first and second holder 120, 121".

Further according to the present disclosure, at least one of first and second holding means 120, 121 are configured such that the area A delimited between the primary headband portion 110 and the secondary headband section 200 may be varied.

Figure 3B:
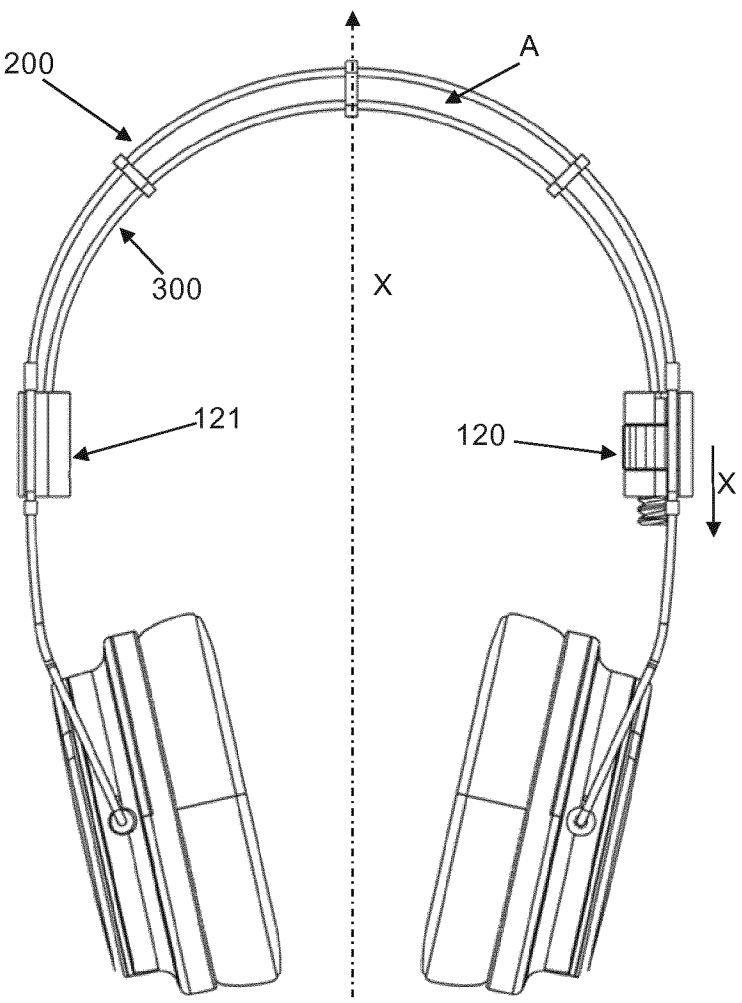
FIG. 3*a*, 3*b*: Schematic drawings showing the headband according to the present disclosure and a pair of headphones in operation.

Turning to FIG. 3*b*. The area A may be delimited by the primary headband section 200 and the first and second holding means 120, 121 (these being part of the primary headband portion 110) and the secondary headband section 200.

Typically, the area A that is delimited between the primary headband portion 110 and the secondary headband section 300 may be varied by moving the secondary headband section 300 towards or away from the primary headband section 200.

Moving the secondary headband section 300 towards the primary headband section also results in that the distance between the secondary headband section 300 and the primary headband section 200 decreases. Moving the secondary headband section 300 away from the primary headband section results in that the distance between the secondary headband section and the primary headband section 200 increases.

Figure 3A:
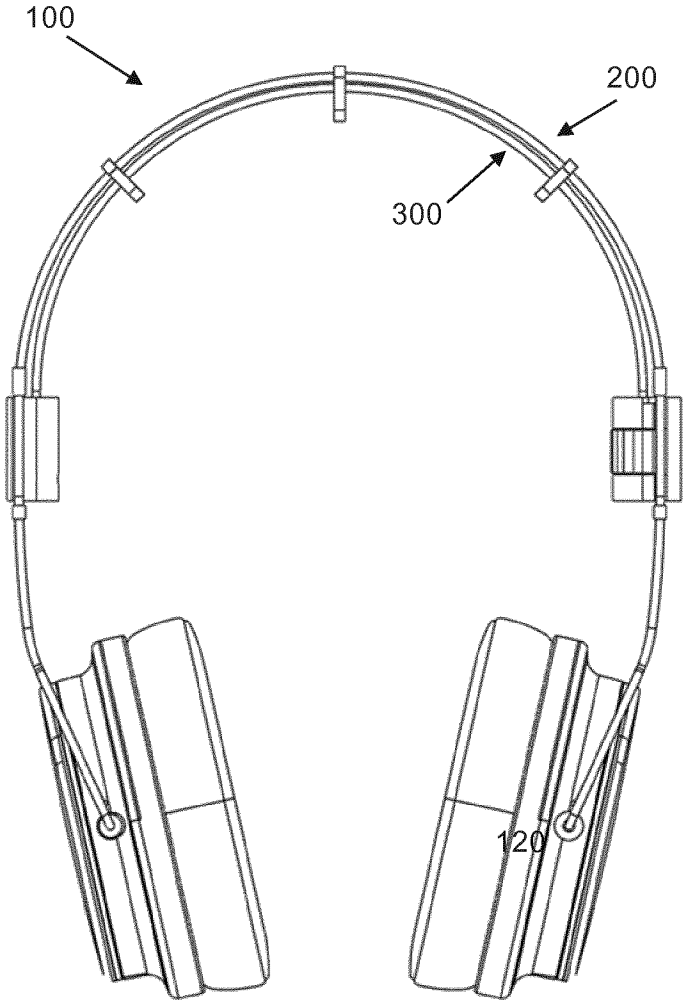

FIG. 3*b* shows a situation in which the secondary headband section 300 of the headband shown in FIG. 3*a* has been moved away from the primary headband section 200. Clearly visible in FIG. 3*b* is that this results in an increase of the area A that is delimited between the primary headband portion 110 and the secondary headband section 300. Movement of the secondary headband 300 towards the primary headband section 200 results in that the area A delimited between the primary arc-shaped headband section and the secondary arc-shaped headband section decreases. Movement of the secondary headband section 300 is achieved by moving the first end 321 (not visible) of the secondary headband section 300 in axial direction X in the first holding means 120 (i.e. in direction parallel to the symmetry axis X).

Thus, further according to the present disclosure the at least first holding means 120 is configured such that the first end 321 of the secondary headband section 300 is movable in opposite axial directions parallel to the symmetry axis X. Moreover, the at least first holding means 120 is configured such that the first end 321 of the secondary headband section 300 may be locked, i.e. held immovable, in a selected axial position in the at least first holding means. Various embodiments of the holding means are possible for achieving these features. A first embodiment is shown in FIG. 2*a*.

Figure 2B:
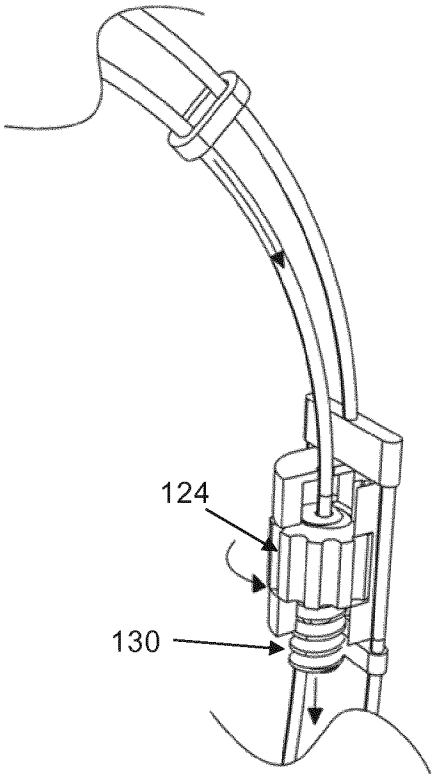
FIG. 2*a*, 2*b*: Schematic drawings of a portion of a headband according to the present disclosure.
Figure 2A:
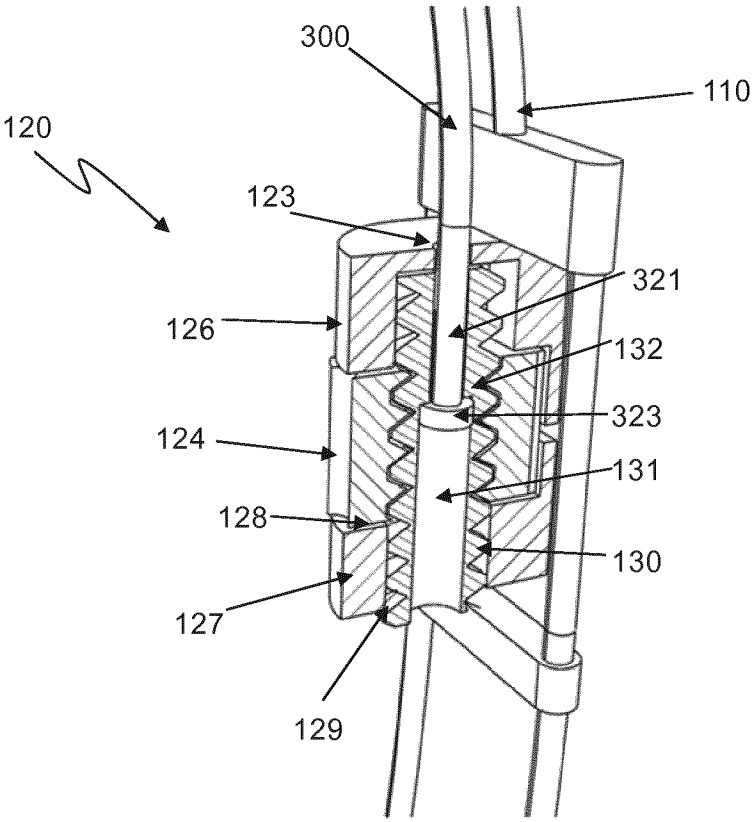

FIG. 2*a* shows the first holding means 120 on the right hand side of the headband of FIG. 1 in cross-section. The first holding means 120 may be holding body that may be cylindrical and that extends axially substantially parallel with the symmetry axis X of the headband (see FIG. 1). The first holding means 120 may comprise an upper holding body 126 and a lower holding body 127 separated by an intermediate spacing 128. One, or both of the upper and the lower holding bodies 126, 127 may be fixed to the primary headband portion 110. An actuator means 124, (may also be denominated operator or operator means 124) in the form of a knob, which also may be cylindrical, is rotationally arranged in the spacing 128. The knob 124 and the upper and lower holding bodies 126, 127 comprises respectively a through bore. Thus, when the knob 124 is arranged in the spacing 128, a through bore 125 extends from an upper opening 123 on the upper holding body 126 to a lower opening 129 on the lower holding body 127. The through bore of the knob 124 comprises a thread. The through bores of the upper and lower holding bodies 126, 127 (i.e. their inner surfaces) are preferably flush. The actuator means 124 may be denominated "actuator 124".

The first holding means 121 further comprises an engagement body 130, which may be cylindrical, with an external thread. The cylindrical engagement body 130 extends within the through bore 125 of the holding body 121 and is coupled to the actuator means 124 by mating engagement between the external thread of the engagement body 130 and the thread formed on the through bore of the knob 124. The cylindrical engagement body 130 comprises a through bore 131 with a shoulder 132 that forms a narrowing in the through bore 131. The first end 321 of the secondary headband section is configured to engage the holding means. The first end 321 thereby comprises a head 323 that the abuts against the shoulder of the through bore 131. The first end 321 of the secondary headband section 310 is received in the through bore of the cylindrical engagement body 130 such that the secondary headband section 300 extends through the upper opening 123 in the upper holding body 126 and the head 232 abuts against shoulder 132.

In operation, as shown in FIG. 2*b*, rotation of the knob 124 in one rotational direction will move the engagement body 130, with regards to the symmetry axis, in a first axial direction e.g. towards the lower holding body 127 and thus move the secondary headband section 300 away from the primary headband section 200. During rotation, the head 323 of the secondary headband section 310 abut against the shoulder 132 in the through bore 131 of the cylindrical engagement body 130 and follows the axial movement of the cylindrical engagement body 130. Rotation of the knob 124 in an opposite second rotation direction (not shown) causes the engagement body 130 to move in a second axial direction e.g. towards the upper holding body 127 and thus moves the secondary headband section 300 towards the primary headband section 200. Tensile forces in the secondary headband section 300 will thereby cause the secondary headband section 200 to spring back towards the primary headband section 200 and follow the movement of the engagement body 130. When the knob 124 is idle (i.e. not turned) the engagement between the threads on the engagement body and the rotational knob 124 locks the engagement body 130 and thus the first end 321 of the secondary headband section 300 in a selected axial position.

The advantage of the embodiment described above is that the secondary headband section may be moved step-less towards and away from the primary headband section. The distance between the secondary headband section and the primary headband section may thus be set with a high degree of accuracy. As a consequence thereof the stiffness of the headband may be accurately adjusted to fit the preferences of the user. A further advantage is that the threaded coupling between knob and engagement body locks the secondary headband in position when the knob is not subjected to turning.

The second holding means 121 may be configured and arranged as the first holding means 120. Thus, also the second holding means 121 may allow for movement of the secondary headband section 300 towards or away from the primary headband section 200. Alternatively, the end portion 322 of the secondary headband section 300 is fixed in the second holding means 121. For example by e.g. a screw joint or by welding or gluing. It is also possible to omit the second holding means 121 and fix the second end of the secondary headband section directly to the primary headband portion.

FIGS. 4*a* and 4*b* shows a second embodiment of the headband 100 according to the present disclosure. Apart from the first and the second holding means 120, 121 this embodiment is substantially identical to the first embodiment of the present disclosure.

According to the second embodiment, The first holding means 120 may be holding body that may be cylindrical and that extends axially substantially parallel with the symmetry axis X of the headband. FIG. 4*b* shows an enlarged view of the encircled area of FIG. 4*a*. Thus, the holding body 120 may be an integral body and comprises a through bore 125 that extends between an upper opening 123 on an upper surface of holding body 121 and a lower opening 129 on a lower surface of the holding body. The first end 321 of the secondary headband section is received in the through bore 125 whereby the secondary headband extends out through the upper opening 123. The secondary headband section 200 and the through bore 125 are configured such that the secondary headband section 200 is received with formfitting in the trough bore 125.

In this embodiment, a person using the headband may pull or push the first end 121 of the secondary headband section 300 through the through hole 125, in a first axial direction with regards to the symmetry axis X. For example downwards towards the lower surface of the holding means 121. This increases the distance between the secondary headband section 300 and the primary headband section 200. Correspondingly, the person using the headband may push or pull the first end 321 of the secondary headband section through the through hole 125 in a second axial direction with regards to the symmetry axis X direction. For example upwards towards the upper surface of the holding means. This decreases the distance between the secondary headband section and the primary headband section.

Form fitting between the through hole 125 and the secondary headband section may be achieved by appropriate selection of materials and dimensioning of the secondary headband section and the trough hole. For example, if the secondary headband section and the through bore have circular cross-section the diameter of secondary headband section may be slightly greater than the diameter of the through bore.

The above embodiment provides a simple and cost effective headband with adjustable stiffness.

FIG. 5 shows a third embodiment of the headband 100 present disclosure. Apart from the first and the second holding means 120, 121 and the design of the first and second ends of the secondary headband section this embodiment is substantially identical to the first embodiment of the present disclosure.

According to the third embodiment, the first holding means 120 comprises a first and a second opening 140, 141 that are spaced apart in axial direction with regards to the symmetry axis X of the headband 100. That is, the first opening 140 is arranged above the second opening 141. The first holding means 120 may be a planar body and is arranged such that the first and the second opening 140, 141 are facing inwards. That is, towards the symmetry axis X of the headband. The first end 321 of the secondary headband section 300 is bent outwards, that is in direction away from the symmetry axis X. Preferably orthogonal to the symmetry axis X. The cross-sectional dimension of the first and the second openings and the cross-sectional diameter of the first end 321 are selected such that the first end 321 of the secondary headband section 300 may be received in the first and the second opening and engage the first and the second opening with form fitting.

In this embodiment, the person using the headband may increase or decrease the area A between the secondary headband section and the primary headband section by moving the first end 321 of the secondary headband section 300 between the first and the second openings 140, 141. This provides for a very cost effective headband with variable stiffness.

Returning to FIG. 1, the headband according to the present disclosure may further comprise at least one joining means 401 for joining the primary and the secondary headband sections 200, 300. The joining means 400 may be annular and encloses a portion, i.e. an arc length, of the primary and the secondary headband section 200, 300. For example may a first joining means 401 be arranged in the center of the first and the second headband section 400. That is, on the symmetry axis X. A second joining means 402 and a third joining means 403 may be arranged on opposite sides of the symmetry axis x and spaced apart from the first joining means. The joining means 401-403 are designed to contact both the primary and the secondary headband sections when the secondary headband section has been moved a predetermined distance from the primary headband section. The joining means 401-403 stabilizes the headband and increases the strength of the headband further when the secondary headband section is moved away from the primary headband section. It is possible that the joining means 400-402 are resilient. For example the joining means may be a helical spring (not shown) that encloses a portion of the primary and secondary headband portion. The joining means 401-403 may be denominated "joiner 401-403".

FIGS. 6*a*, 6*b* and 7*a*, 7*b* shows schematically the functional principle of the headband 100 according to the present disclosure.

Figure 6A:
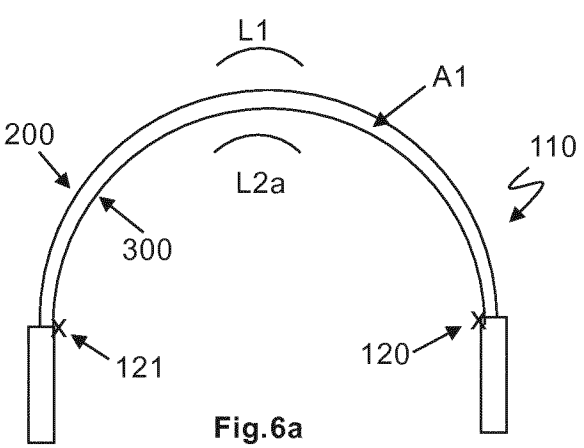
FIGS. 6*a*, 6*b*: Schematic drawings explaining the function of the headband according to the present disclosure.
Figure 6B:
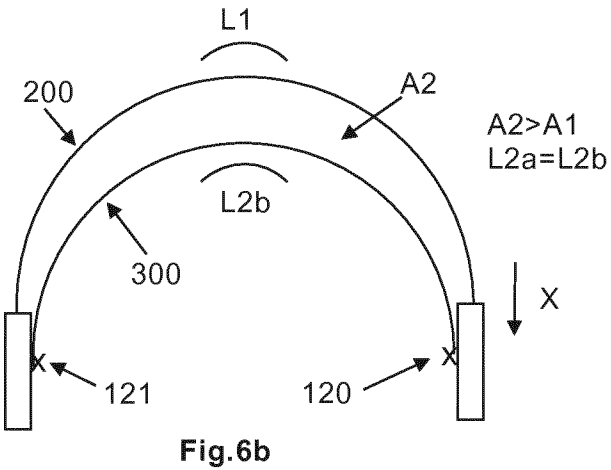

FIG. 6*a*, 6*b* shows schematically the alternative embodiment of the headband described in FIG. 5 of the present disclosure. The primary headband section 200 has an arc-length L1 and the secondary headband section 300 has an arc-length of L2. In FIG. 6*a*, the secondary headband section is attached to the respective holding means 120, 121 in an upper axial position (indicated by "x"). The primary- and secondary headband sections 200, 300 delimit together with the holding means 120, 121 a nominal area A1.

In FIG. 6*b*, the secondary headband section 300 has been moved downwards and is attached to the respective holding means 120, 121 in a lower axial position. The primary- and secondary headband sections 200, 300 thereby delimit a second area A2 that is greater than the nominal area A1. The arc-lengths L2*a* and L2*b* of the secondary headband section remains essential constant in the upper and lower axial position. This is due to the design of the attachment between the bent ends of the secondary headband section and the openings in the holding means (c.f. FIG. 5).

Practical trials have shown that the stiffness of the headband 100 and thus the clamping force towards the ears of the user increases with an increase in the area A delimited between the primary headband portion 110 and the secondary headband section 300. The reason for the stiffness increase is not completely understood. However, without being bound by theory, it is believed that the increase in stiffness may be caused by an increase of the second moment of area of the geometric shape that is formed by the interconnected portions of the primary headband portion 110 and the secondary headband section 300.

In addition the above described joining means 401-403 (not shown) may be employed to clamp the primary and secondary headband sections 200, 300 when the secondary headband section 300 is moved away from the primary headband section 200. The joining means 400-401 stabilizes the structure and prevent that tension stress formed in the primary headband section 200 causes the primary headband section 200 to deform.

Figure 7A:
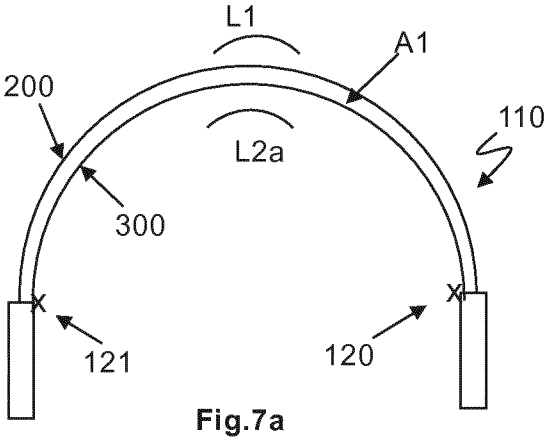
FIGS. 7*a*, 7*b*: Schematic drawings explaining the function of the headband according to the present disclosure.
Figure 7B:
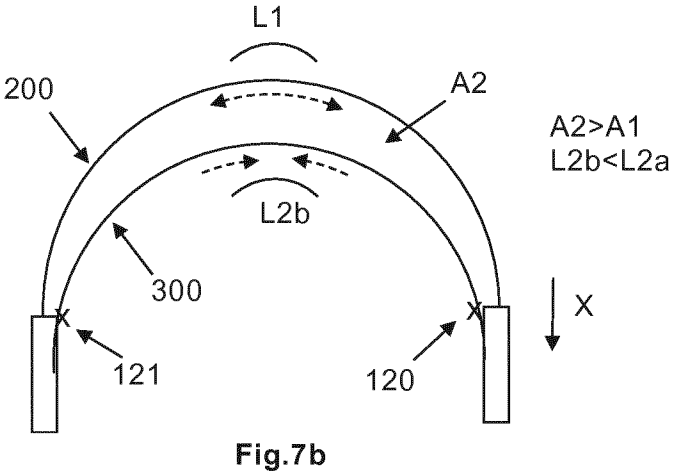

FIGS. 7*a* and 7*b* shows schematically the embodiment of the headband shown in FIG. 1 of the present disclosure. When the ends of the secondary headband is moved in axial direction in the holding means 120, 121 the area A delimited between the primary headband portion 110 and the secondary headband section 300 increase from nominal area A1 to area A2. As described above, this results in an increase in stiffness of the headband which may be the result of an increase in the second moment of area of the interconnected portion of the primary headband section 200 and the secondary headband section 300.

However, due to the design of the holding means 120, 121 of the headband (c.f. FIG. 2*a*, 2*b*) the arc-length of the secondary headband section 300 decreases when the secondary headband section 300 is moved away from the primary headband portion 200. This is so, because the arc-length is the curved portion of the secondary headband portion 300 located above the fixation point in the holding means 120, 121. The decrease in arc-length of the secondary headband section 300 increases the stiffness of the headband 100 further in comparison the embodiment shown in 6*a*, 6*b*. Without being bound by theory, the arc-shaped primary and secondary headband section 200, 300 may be considered to constitute a theoretical curved beam. In such a beam, the outer, primary, headband section is subject to tensile stress (pointed arrows) which work to straighten the beam. However, the reduction of the arc-length of the secondary headband section 300 results in increased compression stress (see dashed arrows) in the secondary headband section 300. This increased compression stress counter-acts the tensile stress in in the primary headband section 200 and results in increased stiffness of the headband 100.

Figure 8B:
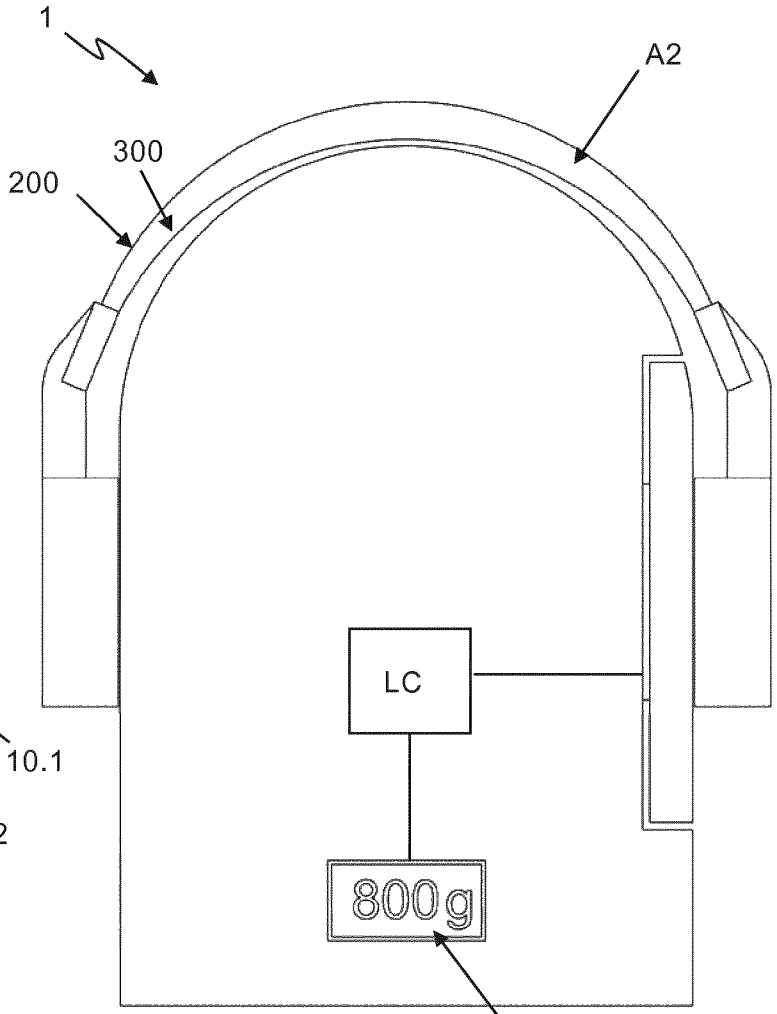
FIGS. 8*a*, 8*b*: Schematic drawings illustrating testing of a headband according to the present disclosure.
Figure 8A:
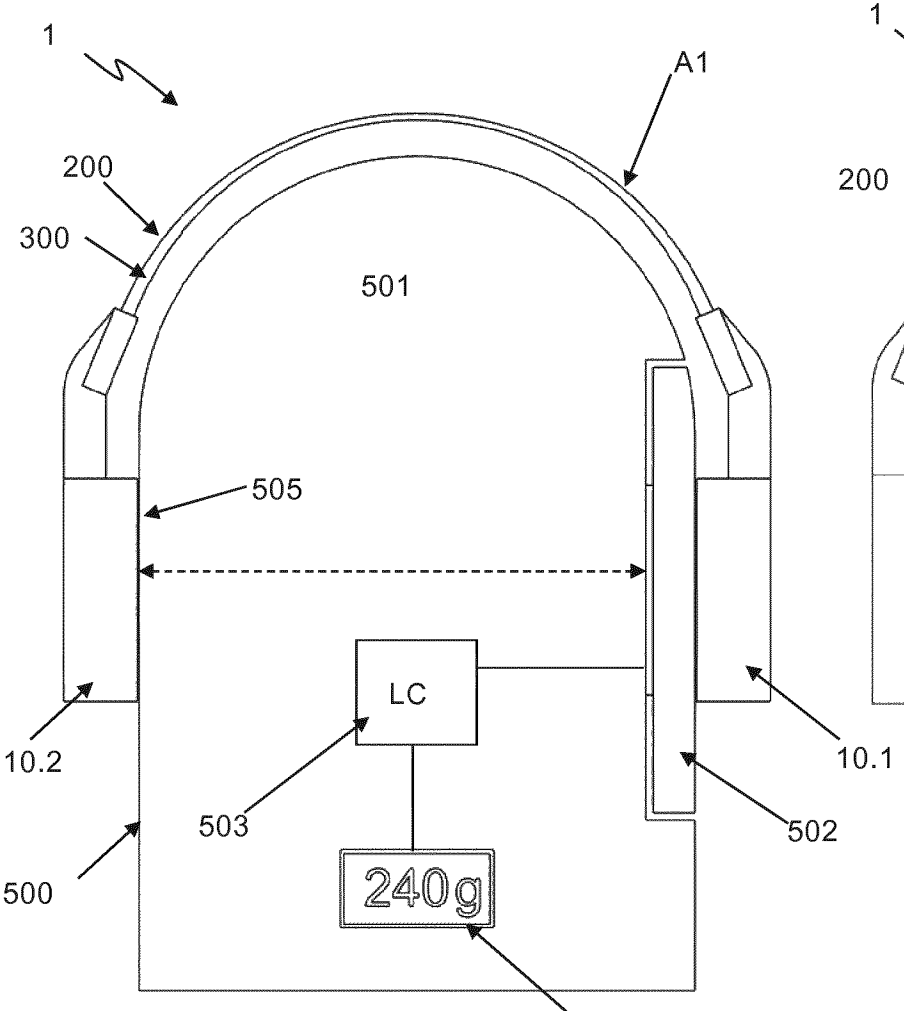

FIGS. 8*a* and 8*b* shows a setup of a practical trial in which the clamping force of a headband 1 according to the embodiment of FIG. 1 was tested.

In the trial, a clamping force meter 500 was used. The clamping force meter 500 comprises a pressure plate 502 which is connected to a load cell 503 which in turn is connected to a display 504. The pressure plate 502, the load cell 503 and the display 504 are components that typically are used in commercial available letter scales or domestic kitchen scales and are also interconnected as such. The clamping force meter 500 further comprises a support surface 501 arranged opposite to the pressure plate 502. The distance between the pressure plate 502 and the support surface 501 is 150 mm and the dimensions of the pressure plate 502 is 120×100 mm. The load cell has an upper limit of 5 kg (50 N).

In FIG. 8*a*, a headset comprising a pair of headphones 10.1, 10.2 and a headband 1 according to the first embodiment of the present disclosure was arranged on the clamping force meter 500 such that one headphone 10.1 was supported on the pressure plate 502 and the other headphone 10.2 on the support surface 501. The area A1 delimited by the primary headband section 200 and the secondary headband section 300 resulted in a clamping force of 240 g (2.4N). The area delimited between the primary and secondary headband sections was subsequently increased to A2 which resulted in an increase of the clamping force to 800 g (8.0 N).

Although a particular embodiment has been disclosed in detail this has been done for purpose of illustration only, and is not intended to be limiting. In particular it is contemplated that various substitutions, alterations and modifications may be made within the scope of the appended claims.

For example, the actuator means 124 may be lever that is coupled to the engagement body by a linkage. In this case the thread on the engagement body may be omitted. It is also possible to attach an actuator means in the form of a handle directly to the engagement body.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A headband for a pair of headphones comprising:

a primary headband portion having a first end and a second end configured to be connected to a respective headphone and an arc-shaped primary headband section extending between the first and the second end of the primary headband portion;

an arc-shaped secondary headband section extending along the arc-shaped primary headband section;

at least a first holding means for holding the arc-shaped secondary headband section to the primary headband portion, wherein the at least first holding means is immovably fixed in an axial direction relative to the primary headband portion; and wherein the at least first holding means is configured such that the arc-shaped secondary headband section can be moved towards or away from the primary headband section such that an area delimited between the primary headband portion and the secondary headband section may be varied.

2. The headband according to claim 1, wherein the secondary headband section is arranged above or underneath the primary headband section.

3. The headband according to claim 1, wherein the at least first holding means is configured to hold the secondary headband section immovable in a selected position relative the primary headband section.

4. The headband according to claim 1, wherein the secondary headband section comprises at least a first end configured to engage the at least first holding means, wherein the at least first holding means is configured such that the at least first end of the secondary headband section is movable in axial direction in the at least first holding means and lockable in a selected axial position.

5. The headband according to claim 1, wherein the holding means are configured such that the arc-length of the secondary headband section is decreased when the secondary headband section is moved away from the primary headband portion and such that the arc-length of the secondary headband section is increased when the secondary headband section is moved towards the primary headband portion.

6. The headband according to claim 1, wherein the at least first holding means comprises a through bore for receiving the at least first end of the secondary headband section, wherein said through bore is oriented substantially parallel with a symmetry axis of the headband and wherein the first end of the secondary headband section is axially movable in the through bore.

7. The headband according to claim 6, wherein the at least first holding means comprises:

an engagement body arranged in the through bore and configured to hold the first end of the secondary headband section; and an actuator means configured to be manually actuated, wherein the engagement body and the actuator means are coupled such that the engagement body is moved in a first axial direction when the actuator means is actuated in a first operating direction and such that the engagement body is moved in a second axial direction when the actuator means is actuated in a second operating direction.

8. The headband according to claim 7, wherein the engagement body is cylindrical and comprises an external thread and wherein the actuator means is a rotatable knob with a threaded bore for engagement with the external thread of the engagement body, wherein rotation of the actuator means in a first rotational direction moves the engagement body in a first axial direction and rotation of the actuator means in a second rotational direction moves the engagement body is a second axial direction.

9. The headband according to claim 8, wherein the secondary headband section is step-less movable relative to the primary headband section.

10. The headband according to claim 1, wherein the at least first holding means comprises a first and a second opening spaced apart in axial direction and facing towards the symmetry axis and wherein the first end of the secondary headband section is configured to be selectively received in the first and the second opening.

11. The headband according to claim 10, further comprising at least one joining means for joining the primary headband section and the secondary headband section.

12. The headband according to claim 11, wherein the joining means is annular and encloses a portion of the primary headband section and a portion the secondary headband section such that the primary headband section and the secondary headband section are coupled when the primary headband section is moved away from the primary headband section.

13. A headset comprising a pair of headphones and a headband according to claim 1.

* * * * *